US010550739B2

(12) United States Patent
Raimondi

(10) Patent No.: US 10,550,739 B2
(45) Date of Patent: Feb. 4, 2020

(54) VALVETRAIN WITH VARIABLE VALVE ACTUATION

(71) Applicant: Eaton SRL, Turin (IT)

(72) Inventor: Emanuele Raimondi, San Francesco al Campo (IT)

(73) Assignee: EATON INTELLIGENT POWER LIMITED, Dublin (IE)

( * ) Notice: Subject to any disclaimer, the term of this patent is extended or adjusted under 35 U.S.C. 154(b) by 87 days.

(21) Appl. No.: 15/313,959

(22) PCT Filed: May 27, 2015

(86) PCT No.: PCT/EP2015/061768
§ 371 (c)(1),
(2) Date: Nov. 24, 2016

(87) PCT Pub. No.: WO2015/181264
PCT Pub. Date: Dec. 3, 2015

(65) Prior Publication Data

US 2017/0198613 A1 Jul. 13, 2017

(30) Foreign Application Priority Data

May 27, 2014 (GB) ..... 1409354.6

(51) Int. Cl.
*F01L 13/00* (2006.01)
*F01L 1/18* (2006.01)
(Continued)

(52) U.S. Cl.
CPC ..... *F01L 13/0036* (2013.01); *F01L 1/047* (2013.01); *F01L 1/14* (2013.01); *F01L 1/185* (2013.01); *F01L 1/34* (2013.01); *F01L 2013/103* (2013.01)

(58) Field of Classification Search
CPC ..... F01L 1/185; F01L 2001/186; F01L 1/46; F01L 13/0036; F01L 2105/00; F01L 2800/06; F01L 2820/032
(Continued)

(56) References Cited

U.S. PATENT DOCUMENTS 4,203,397 A * 5/1980 Soeters, Jr. ..... F01L 1/2405 123/198 F
4,656,977 A 4/1987 Nagahiro et al.
(Continued)

FOREIGN PATENT DOCUMENTS

CN 101581239 A 11/2009
DE 19700316 A1 7/1997
(Continued)

*Primary Examiner* — Jorge L Leon, Jr.
(74) *Attorney, Agent, or Firm* — Leydig, Voit & Mayer, Ltd.

(57) ABSTRACT

A valvetrain assembly has valves each having a valve stem; a main camshaft with main cams, a main cam corresponding to each valve; main rocker arms each corresponding to a valve and having a valve stem actuation portion, a pivot axis parallel to the main cam shaft, and a main cam follower for following the corresponding main cam, wherein the valve stem actuation portion, pivot axis, and main cam follower are arranged along the main rocker arm length distanced from each other; an auxiliary cam on the main camshaft; an auxiliary cam follower for each auxiliary cam, following the auxiliary cam, wherein each auxiliary cam follower is movable on one main rocker arm between a first and second position; a latch on respective main rocker arm(s) for locking the auxiliary cam follower in the first position; and an auxiliary camshaft with a selector cam for each latch, controlling the latch.

7 Claims, 4 Drawing Sheets

(51) Int. Cl.
*F01L 1/047* (2006.01)
*F01L 1/14* (2006.01)
*F01L 1/34* (2006.01)

(58) Field of Classification Search
USPC ..... 123/90.16, 90.17, 90.27, 90.31, 90.44
See application file for complete search history.

(56) References Cited

U.S. PATENT DOCUMENTS 4,762,096 A 8/1988 Kamm et al.
5,653,198 A * 8/1997 Diggs ..... F01L 1/185 123/198 F
5,655,488 A * 8/1997 Hampton ..... F01L 1/185 123/90.16
6,314,928 B1 * 11/2001 Baraszu ..... F01L 1/185 123/198 F
6,591,798 B2 * 7/2003 Hendriksma ..... F01L 1/18 123/90.16
7,621,242 B2 11/2009 Kitagawa et al.
2003/0192497 A1 * 10/2003 Hendriksma ..... F01L 1/053 123/90.44
2008/0149059 A1 * 6/2008 Murphy ..... F01L 1/18 123/90.39
2009/0199800 A1 * 8/2009 Reinicke-Murmann ..... F01L 1/185 123/90.17
2010/0162979 A1 * 7/2010 Kreuter ..... F01L 13/0036 123/90.17
2012/0067309 A1 * 3/2012 Murai ..... F02D 13/0226 123/90.1
2013/0306013 A1 * 11/2013 Zurface ..... F01L 1/18 123/90.16

FOREIGN PATENT DOCUMENTS

EP 0267696 A1 5/1988
EP 0462853 A1 12/1991
EP 1462623 A1 9/2004
EP 1544422 A1 5/2005
EP 2653673 A1 10/2013
JP 2007198363 A 8/2007
WO WO 9428288 A2 12/1994

* cited by examiner

VALVETRAIN WITH VARIABLE VALVE ACTUATION

CROSS-REFERENCE TO RELATED APPLICATIONS

This application is a U.S. national stage application under 35 U.S.C. § 371 of International Application No. PCT/EP2015/061768, filed on May 27, 2015, and claims benefit to British Patent Application No. 1 409 354.6, filed on May 27, 2014. The International Application was published in English on Dec. 3, 2015, as WO 2015/181264 A1 under PCT Article 21(2).

FIELD

The invention relates to a valvetrain assembly including a number of valves each having a valve stem; —at least one main camshaft with a number of main cams, at least one main cam corresponding to each valve; —and a number of main rocker arms.

BACKGROUND

A valvetrain assembly is commonly known and used in combustion engines to ensure that the valves are opened and closed in synchronization with the movement of the pistons in the cylinders.

The timing and lift of the valves is determined by the profile of the cam corresponding to the specific valve. However, the profile is static and cannot be changed, so the profile is a compromise between for example fuel consumption, power and emissions.

It is further known in the prior art to provide a variable valve actuation to change the timing and lift of the valves while running the engine. Numerous techniques are used to achieve this.

One technique is providing two differently shaped cams on the cam shaft for each valve and shifting the camshaft axially while running the engine. This allows one to use two different valve timing profiles. For example, one profile to have high power, but also high fuel consumption and emissions, and the other profile for less power, but better fuel consumption and lower emission.

Another technique is to change the phase of the camshaft, such that the lifting of the valves is advanced or delayed. By for example delaying the closing of the exhaust valve, will ensure that more burned fuel is driven out of the cylinder, such that more fuel can be burned in the next stroke.

Also electro-hydraulic systems are used in which a body is arranged between the cam and the valve, which can either transmit the actuation by the cam or absorb the actuation. To this end, the body is telescopic and filled with hydraulic fluid. When a drain opening is closed by an electric valve, the body is stiff and cannot collapse and the valve is actuated by the cam. However, when the drain opening is opened, the hydraulic fluid can be pushed out and the body can be compressed, such that the actuation of the cam is absorbed and the valve stays in a closed position.

Now by electronically controlling the electric valve one can change the profile of the cam and therefor the timing and lift of the valve. If the full profile of the cam is to be used, the valve remains closed, but if only part of the valve lift is desired, the electric valve is opened during the actuation of the valve by the cam.

However, the temperature, the pressure and the viscosity of the hydraulic oil influences the characteristics of electro-hydraulic variable valve actuation.

It is furthermore known to operate the valves without the use of cams, for example by a solenoid type of actuation system. However, such systems are complex and with high costs, as such an actuator is needed for each valve of a combustion engine.

SUMMARY

An aspect of the invention provides a valvetrain assembly, comprising: a first and a second valve each having a valve stem; a main camshaft including a first and second main cam, at least one main cam corresponding to each valve; a first and second main rocker arms, each main rocker arm corresponding to a valve and including a valve stem actuation portion, a pivot axis parallel to the main cam shaft, and a main cam follower configured to follow a corresponding main cam, wherein the valve stem actuation portion, the pivot axis, and the main cam follower are arranged along a length of the main rocker arm and at a distance from each other; an auxiliary cam arranged on the main camshaft; an auxiliary cam follower for the auxiliary cam, the auxiliary cam follower being configured to follow the auxiliary cam, wherein the auxiliary cam follower is movably arranged on one of the main rocker arms between a first and a second position; a latch, arranged on the respective main rocker arm, configured to lock the auxiliary cam follower in the first position; and an auxiliary camshaft including a selector cam for the latch configured to control the latch.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
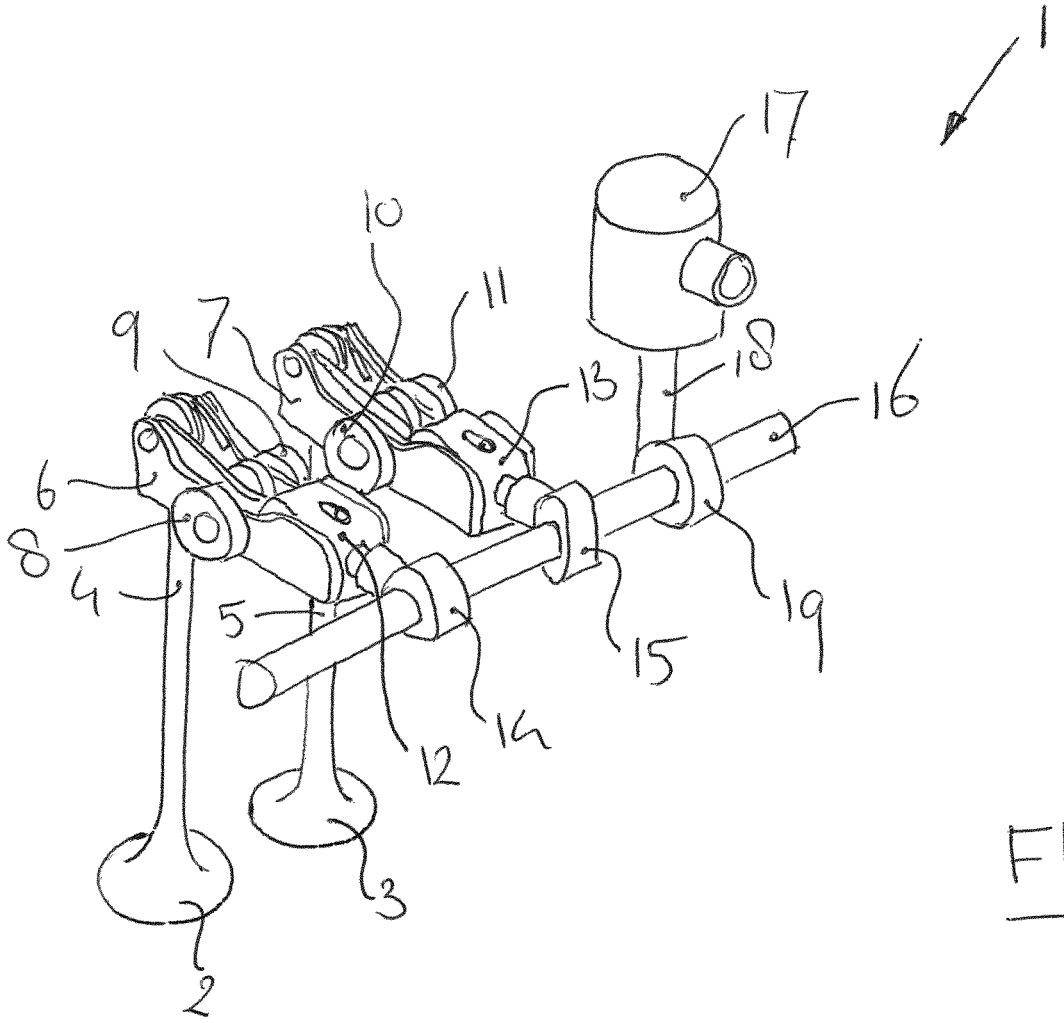
FIG. 1 shows a perspective view of an embodiment of the valvetrain assembly according to the invention.

An aspect of the invention provides a valvetrain system according to the preamble, in which the above mentioned disadvantages are reduced or even removed.

An aspect of the invention relates to a valvetrain assembly comprising: —a number of valves each having a valve stem; —at least one main camshaft with a number of main cams, at least one main cam corresponding to each valve; —a number of main rocker arms, each main rocker arm corresponding to a valve and having a valve stem actuation portion, a pivot axis parallel to the main cam shaft and a main cam follower for following the corresponding main cam, wherein the valve stem actuation portion, the pivot axis and the main cam follower are arranged along the length of the main rocker arm and at a distance from each other.

An aspect of the invention provides a valvetrain system characterized by:

at least one auxiliary cam arranged on the main camshaft;

at least one auxiliary cam follower for each auxiliary cam and for following said auxiliary cam, wherein each auxiliary cam follower is movable arranged on one of the main rocker arms between a first and a second position;

a latch arranged on the respective main rocker arm for locking the auxiliary cam follower in the first position; and at least one auxiliary camshaft with a selector cam for each latch to control said latch.

With the valvetrain according to an aspect of the invention, an auxiliary cam is provided on the main cam shaft, which can be switched on and switched off by controlling the latch. This latch is controlled by an auxiliary cam shaft, which makes it possible to turn on or off a number of latches of adjacent valves simply by rotating the auxiliary cam shaft in the desired position.

When the latch is locked, the auxiliary cam will either alter the profile of the main cam or even fully replace the profile of the main cam. When the latch is unlocked, the auxiliary cam follower can freely move between the first and second position, such that the auxiliary cam is in fact disabled. Only the main cam will impose its profile onto the valve.

With the valve train system according to the invention, it is possible to provide all valves with two different profiles for lift and timing, but is also possible to only provide a selected number of valves with this functionality. For example, only the first intake valve of each cylinder can be provided with a double profile. It would also be possible to provide switch-off functionality to an engine with a large number of cylinders. With this functionality some of the cylinders can be turned off, when the engine produces only part of its maximum power.

In a preferred embodiment of the valvetrain assembly according to the invention the auxiliary cam follower is arranged on a free end of an auxiliary rocker arm, which is pivotable arranged with the opposite end to the main rocker arm.

With an auxiliary rocker arm one can achieve a large stroke of the auxiliary cam follower between the first and second position. This stroke can for example be larger than the height of the main rocker arm.

Preferably, spring means are arranged between the auxiliary rocker arm and the main rocker arm for urging the auxiliary cam follower to the first position. The spring means also ensure that the auxiliary cam follower will not jump around when in an unlocked state due to the vibrations of the engine.

In a further preferred embodiment of the valvetrain assembly according to the invention the latch comprises a pin movable in the length of the main rocker arm, wherein one end of the pin is engagable on the auxiliary rocker arm and wherein the pin is urged with the other end in contact with the selector cam on the auxiliary cam shaft.

When the auxiliary rocker arm is more or less aligned with the main rocker arm, the auxiliary rocker arm can easily be locked just by sliding the pin into a hole in the auxiliary rocker arm. This will require virtually no force, such that rotation of the auxiliary cam shaft can be performed quickly. By arranging a spring between the selector cam and the sliding pin, it is ensured that the selector cam can be rotated at any time, while the sliding pin will slide into the auxiliary rocker arm as soon as the auxiliary rocker arm is aligned with the main rocker arm.

In yet a further embodiment of the valvetrain assembly according to the invention the valve stem actuation portion is arranged on one end of the rocker arm, the pivot axis is arranged on the other end of the rocker arm, and the main cam follower is arranged between the valve stem actuation portion and the pivot axis.

By providing the pivot axis at the other end of the rocker arm, a nearly stationary portion of the rocker arm is easily accessible. It is accordingly preferred to arrange the latch adjacent to the pivot axis, such that it can be easily controlled by the selector cam.

Yet another embodiment of the valvetrain assembly according to the invention comprises electric drive means for driving the auxiliary cam shaft. These electric drive means can be a stepper motor directly coupled to the auxiliary cam shaft or another electric drive means coupled to the cam shaft via a gear transmission.

Yet another preferred embodiment of the valvetrain assembly according to the invention comprises at least a first and a second valve both corresponding to a single cylinder of a combustion engine, wherein a first selector cam for the first valve has a profile different from the profile of the second selector cam for the second valve.

With this embodiment it is for example possible to select whether a first intake valve, a second intake valve or both intake valves are provided with an alternative lift and timing profile.

In still a further embodiment of the valvetrain assembly according to the invention a main cam comprises two identical, disc like, cam portions, wherein the corresponding auxiliary cam is arranged between the two identical cam portions, and wherein the main rocker arm has two main cam followers mirror-symmetrically arranged with respect to the length of the rocker arm.

By designing the main rocker arm, auxiliary rocker arm and corresponding cams mirror-symmetrically, it is ensured that the forces on the components of the valvetrain are minimized and no undesired moments are present within the valvetrain.

FIG. 1 shows a perspective view of an embodiment of the valvetrain assembly 1 according to the invention.

The FIG. 1 shows two valves 2, 3, for example intake valves of a single cylinder. The respective valve stems 4, 5 are actuated by main rocker arms 6, 7. Each rocker arm 6, 7 has two main cam followers 8, 9, 10, 11 arranged in the center of each rocker arm 6, 7.

The main rocker arms 6, 7 have each at the pivot axis end a latch 12, 13 respectively. These latches 12, 13 are operated by their respective selector cam 14, 15 arranged on an auxiliary cam shaft 16. The auxiliary cam shaft 16 is rotated by an electric motor 17 coupled to the cam shaft 16 via gears 18, 19.

Figure 2:
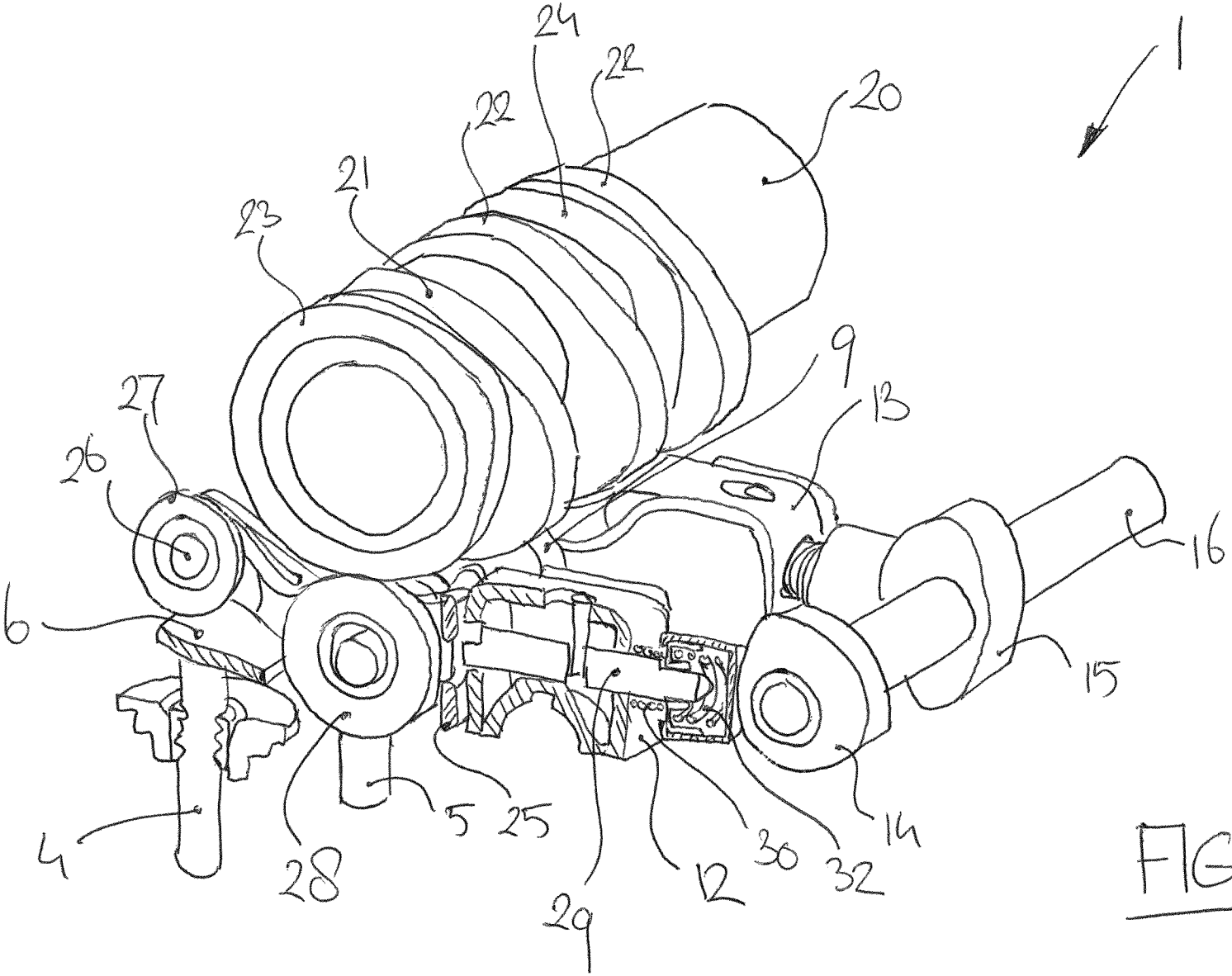
FIG. 2 shows an enlarged perspective view partially in cross section of the valvetrain assembly of FIG. 1.

FIG. 2 shows an enlarged perspective view partially in cross section of the valvetrain assembly 1 of FIG. 1. In this FIG. 2 also a main cam shaft 20 is depicted having main cams 21, 22 and auxiliary cams 23, 24.

Each main rocker arm 6, 7 has an auxiliary rocker arm 25 pivotable around an axle 26. A spring 27 is arranged around the axle 26 and attached to the auxiliary rocker arm 25 to urge the arm 25 upwardly. The auxiliary rocker arm 25 is furthermore provided with an auxiliary cam follower 28, which follows the profile of the auxiliary cam 23.

The latch 12 operated by the selector cam 14 on the auxiliary cam shaft 16 has a pin 29, which is movable in the length of the main rocker arm 6. Springs 30 urge the pin 29 against the selector cam 14. The other end of the pin can be shifted into the auxiliary rocker arm 25 to lock the auxiliary rocker arm 25 to the main rocker arm 6. The springs 32 arranged between the pin 29 and the selector cam 14 ensure that the selector cam 14 can be rotated at any time, even when the auxiliary rocker arm is 25 is not yet aligned with the main rocker arm 6.

Figure 3A:
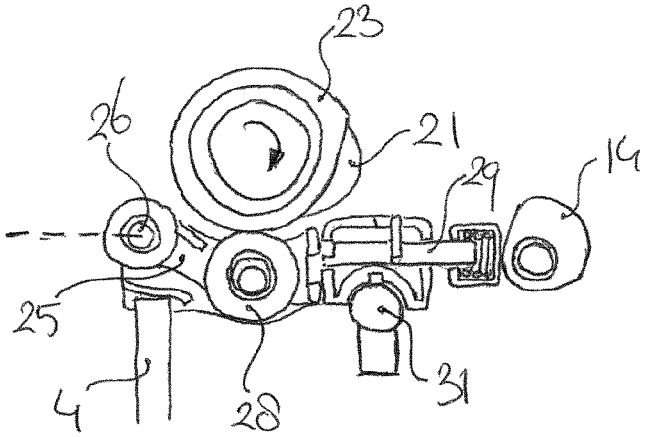
FIGS. 3A-3C show a cross sectional view of the valvetrain assembly of FIG. 1 in three positions with unlocked latch.
Figure 3A:
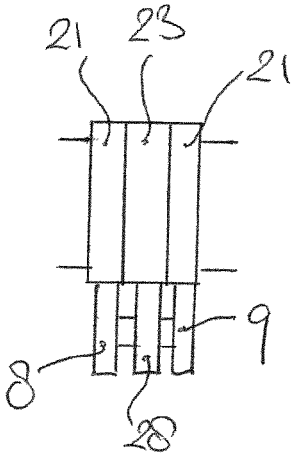
Figure 3B:
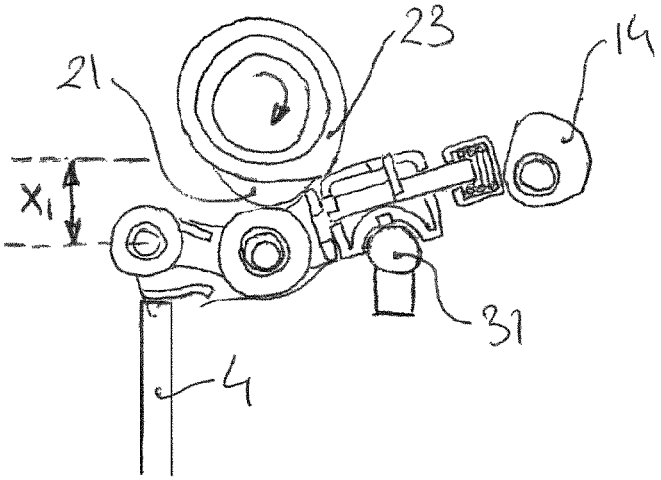
Figure 3B:
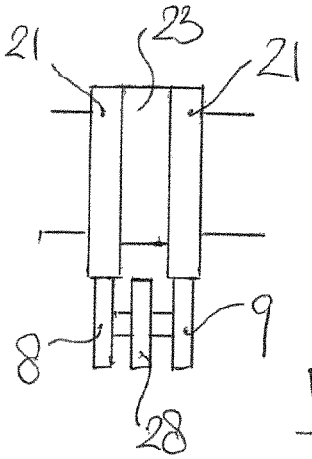
Figure 3C:
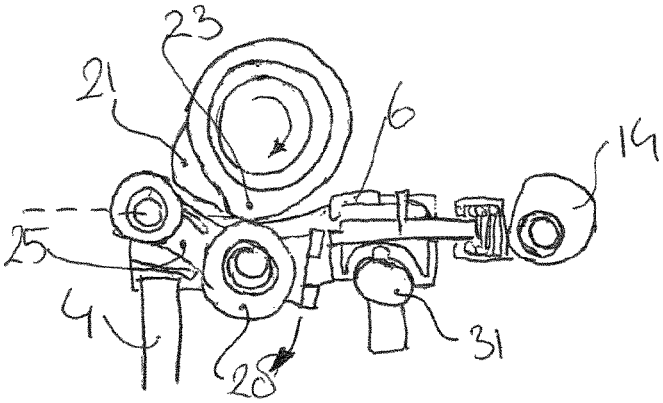
Figure 3C:
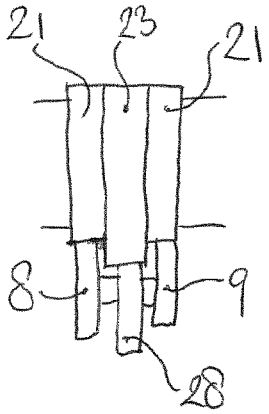

FIGS. 3A-3C show a cross sectional view of the valvetrain assembly 1 of FIG. 1 in three positions of the main cam shaft 20 with unlocked latch 12.

In FIG. 3A, the valve stem 4 is in a closed position. The main rocker arm 6 is in substantial horizontal position. The pivot axis of the main rocker arm 6 is shown as a sphere shaped support 31. The selector cam 14 is in a position in which the pin 29 is out of engagement with the auxiliary rocker arm 25. This allows the rocker arm 25 to pivot freely around the axle 26.

Furthermore FIG. 3A shows that the main cam followers 8, 9 are in contact with the main cam 21, while the auxiliary cam follower 28 is in contact with the auxiliary cam 23.

In FIG. 3B, the main cam shaft 20 is rotated such that the cam lobe of the main cam 21 pushes the main cam followers 8, 9 down, such that the main rocker arm 6 is tilted and the valve stem 4 is lifted over a distance $x_1$. In this position the auxiliary cam follower 28 is out of contact with the auxiliary cam 23.

In FIG. 3C, the main cam shaft 20 is rotated further, such that the cam lobe of the main cam 21 is again out of contact with the main cam followers 8, 9 and the main rocker arm 6 is again tilted back to its horizontal position and the valve stem 4 is closed again.

In this shown position of the main cam shaft 20, the lobe of the auxiliary cam 23 is in contact with the auxiliary cam follower 28. As the auxiliary rocker arm 25 is in an unlocked state, the auxiliary rocker arm 25 is pivoted down within the main rocker arm 6 without having an effect on the valve stem 4. All cam followers 8, 9, 28 are in contact with their respective cam 21, 23 on the main cam shaft 20.

Figure 4A:
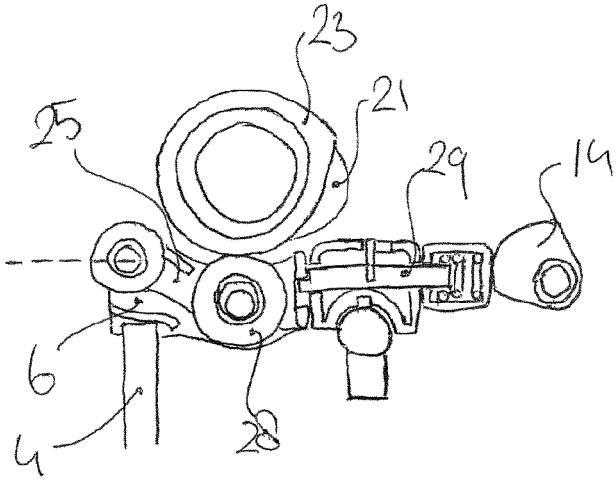
FIGS. 4A-4C show a cross sectional view of the valvetrain assembly of FIG. 1 in three positions with locked latch.
Figure 4A:
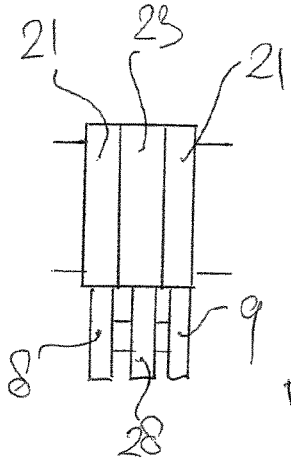
Figure 4B:
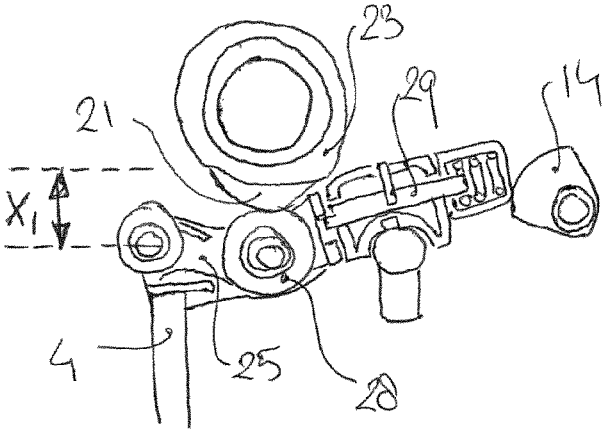
Figure 4B:
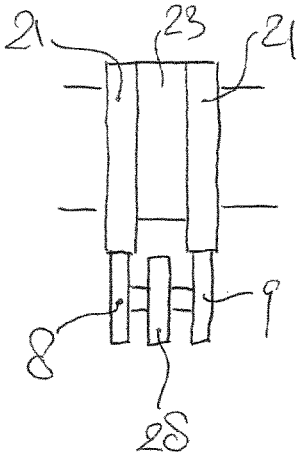
Figure 4C:
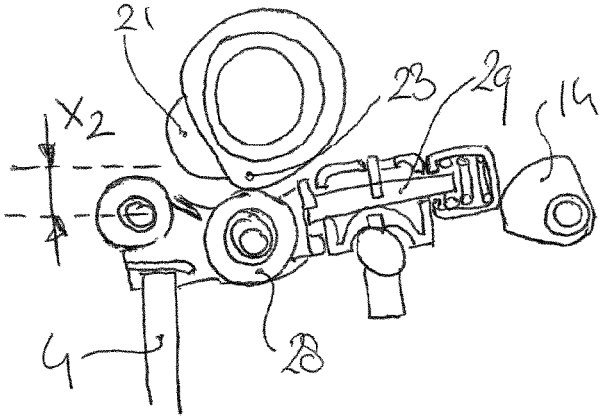
Figure 4C:
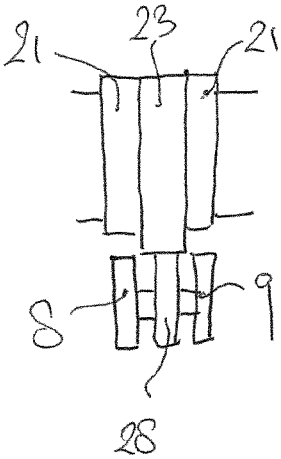

FIG. 4A-4C show a cross sectional view of the valvetrain assembly 1 of FIG. 1 in the same three positions as shown in the FIGS. 3A-3C, however with a locked latch 12.

In order to lock latch 12, the auxiliary cam shaft 16 is rotated, such that the lobe of the selector cam 14 shifts the pin 29 in longitudinal direction of the main rocker arm 6, and such that the pin 29 is inserted into the auxiliary rocker arm 25.

FIG. 4A shows again the horizontal rest position, similar to FIG. 3A in which the cam followers 8, 9, 28 are in contact with their respective cams 21, 23.

In FIG. 4B, the main cam shaft 20 is rotated such that the lobe of the main cam 21 is in contact with the cam followers 8, 9, which causes the main rocker arm 6 to tilt and the valve stem 4 to lift over a distance $x_1$, again similar to FIG. 3B.

In FIG. 4C, the main cam shaft 20 is rotated further, such that the lobe of the auxiliary cam 23 is in contact with the auxiliary cam follower 28. In contrast to FIG. 3C, the auxiliary rocker arm 25 can not pivot down, as it is locked to the main rocker arm 6 by the pin 29. So, as a result, the main rocker arm 6 will be pivoted by the profile of the auxiliary cam 23, such that the valve stem 4 is still lifted over a distance $x_2$. In this position, the main cam followers 8, 9 will no longer be in contact with the main cam 21, and only the auxiliary cam follower 28 will have direct contact with the auxiliary cam 23.

By selecting a suitable profile for both the main cam 21 and the auxiliary cam 23, one can provide a desired valve lift and timing for the locked state and the unlocked state.

As the latch 12, 13 of each valve 2, 3 is controlled by a separate selector cam 14, 15 one can also provide a desired locking and unlocking pattern by providing the correct profile to the selector cams 14, 15.

In FIGS. 1 and 2, the cam 14 is shown with a substantially sector shaped profile, while cam 15 has a substantially oval profile. As a result, one can obtain the following states by rotating the auxiliary cam shaft 16 in steps of 90°: both valves 2, 3 unlocked; valve 2 unlocked, valve 3 locked; valve 2 locked, valve 3 unlocked; both valves 2, 3 locked.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

The invention claimed is:

1. A valvetrain assembly, comprising:

a first and a second valve each having a valve stem;

a main camshaft including at least one main cam corresponding to each of the first and second valves;

a first and second main rocker arm corresponding to the first and second valve, respectively, and each of the first and second main rocker arms including:

a valve stem actuation portion, a pivot axis parallel to the main camshaft, at least one main cam follower configured to follow a corresponding one of the at least one main cam, wherein the valve stem actuation portion, the pivot axis, and the at least one main cam follower are arranged along a length of the main rocker arm and at a distance from each other, an auxiliary cam follower configured to follow an auxiliary cam arranged on the main camshaft, wherein the auxiliary cam follower is movably arranged on the main rocker arm between a first and a second position, and a latch configured to lock the auxiliary cam follower in the first position;

wherein each latch corresponds to and is controlled by a selector cam arranged on an auxiliary camshaft, wherein the first and the second valve both correspond to a single cylinder of a combustion engine, and wherein each selector cam includes:

a first selector cam associated with the first valve, the first selector cam having a first profile, and a second selector cam associated with the second valve, the second selector cam having a second profile different from the first profile.

2. The valvetrain assembly of claim 1, each of the first and second main rocker arms further comprising:

a spring arranged between an auxiliary rocker arm and the main rocker arm, configured to urge the auxiliary cam follower to the first position.

3. The valvetrain assembly of claim 1, wherein each latch includes a pin movable in a length of the main rocker arm such that:

a first end of the pin is engageable on an auxiliary rocker arm, and the pin is urged with a second end in contact with the selector cam on the auxiliary camshaft.

4. The valvetrain assembly of claim 1, wherein each valve stem actuation portion is arranged on a first end of the main rocker arm such that:

the pivot axis is arranged on a second end of the main rocker arm, and the at least one main cam follower is arranged between the valve stem actuation portion and the pivot axis.

5. The valvetrain assembly of claim 4, wherein each latch is arranged adjacent to the pivot axis.

6. The valvetrain assembly of claim 1, further comprising:

an electric driver, configured to drive the auxiliary camshaft.

7. The valvetrain assembly of claim 1, wherein each of the at least one main cams includes a first and a second identical, disc like, cam portion such that:

the auxiliary cam is arranged between the first and second identical cam portions, and the at least one main cam follower includes a first and second main cam follower mirror-symmetrically arranged with respect to a rocker arm length.

* * * * *